US009085852B2

(12) United States Patent
Maier

(10) Patent No.: US 9,085,852 B2
(45) Date of Patent: Jul. 21, 2015

(54) NON-THERMOSET SHEET-LIKE STRUCTURE FOR A SPIRAL SIEVE, AND METHOD FOR MANUFACTURING A SPIRAL SIEVE

(75) Inventor: Oliver Maier, Bad Ueberkingen (DE)

(73) Assignee: WUERTTEMBERGISCHE SPIRALSIEBFABRIK GMBH, Ebersbach (DE)

( * ) Notice: Subject to any disclaimer, the term of this patent is extended or adjusted under 35 U.S.C. 154(b) by 0 days.

(21) Appl. No.: 14/130,780

(22) PCT Filed: Jun. 18, 2012

(86) PCT No.: PCT/EP2012/061559

§ 371 (c)(1),
(2), (4) Date: Jan. 3, 2014

(87) PCT Pub. No.: WO2013/004474

PCT Pub. Date: Jan. 10, 2013

(65) Prior Publication Data

US 2014/0130998 A1 May 15, 2014

(30) Foreign Application Priority Data

Jul. 6, 2011 (DE) ..... 10 2011 078 724

(51) Int. Cl.
*D21F 1/00* (2006.01)

(52) U.S. Cl.
CPC ..... *D21F 1/0072* (2013.01); *Y10T 156/10* (2015.01)

(58) Field of Classification Search
USPC ..... 162/289, 358.2, 900–902; 428/222, 223
See application file for complete search history.

(56) References Cited

U.S. PATENT DOCUMENTS

| | | | |
|---|---|---|---|
| 5,364,692 | A | 11/1994 | Bowen, Jr. et al. |
| 5,514,456 | A | 5/1996 | Lefferts |
| 2006/0124268 | A1 | 6/2006 | Billings |

FOREIGN PATENT DOCUMENTS

| | | | |
|---|---|---|---|
| DE | 24 19 751 | A1 | 12/1975 |
| DE | 10 2007 055 759 | A1 | 6/2009 |
| EP | 0 666 366 | A1 | 8/1995 |
| JP | 9-313835 | | 12/1997 |

OTHER PUBLICATIONS

Form PCT/ISA/210 International Search Report date of mailing Jul. 27, 2012 (2 pages).

(Continued)

*Primary Examiner* — Mark Halpern
(74) *Attorney, Agent, or Firm* — Flynn, Thiel, Boutell & Tanis, P.C.

(57) ABSTRACT

A method for producing a spiral link fabric with a plurality of spirals joined to one another in an overlapping manner, with a plurality of seam wires stitched into overlapping regions of adjacent spirals and connecting the spirals to one another to form a flat structure, and with a plurality of packing elements introduced into free cross sections of the spirals, wherein the flat structure runs through a thermofixing operation before or after the introduction of the packing elements. The spirals are joined together to form the flat structure such that, before the thermofixing operation, the result is a clear width, as viewed in the plane of the flat structure, for the free cross sections of the spirals connected to one another to form the flat structure, which clear width is larger than a clear height of the free cross section of each spiral.

17 Claims, 3 Drawing Sheets

(56) References Cited

OTHER PUBLICATIONS

Form PCT/ISA/237 Written Opinion of International Searching Authority dated Jul. 27, 2012 (6 pages).
German Patent Office Examination Report issued in German Application No. 10 2011 078 724.0 dated Feb. 27, 2012 (6 pages).
Form PCT/IB/373 English translation of International Preliminary Report on Patentability issued in International Application No. PCT/EP2012/061559, dated Jan. 7, 2014 (1 page).
Form PCT/ISA/237 English translation of Written Opinion of the International Searching Authority issued in International Application No. PCT/EP2012/061559 date of mailing Jul. 27, 2012 (6 pages).

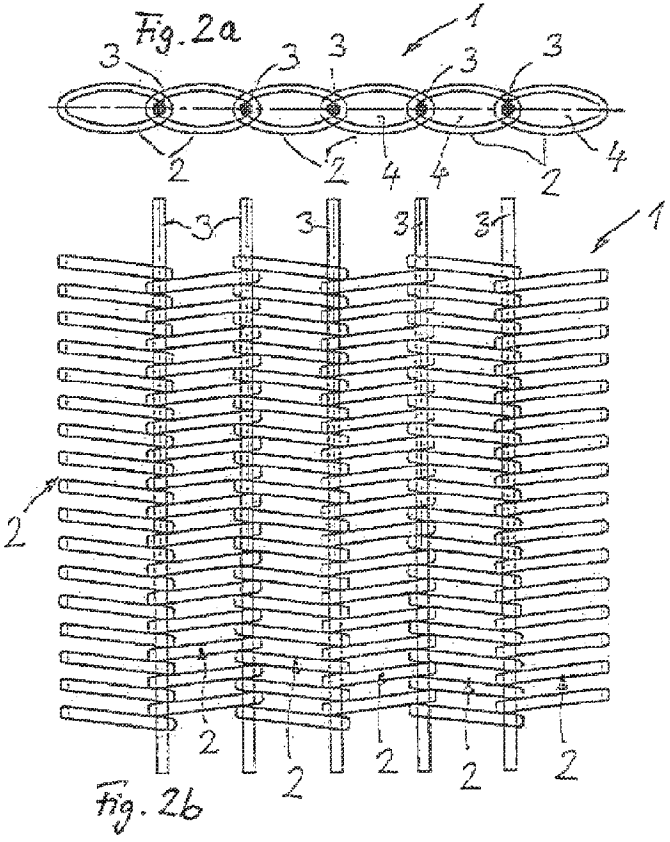
Fig. 2a
Fig. 2b
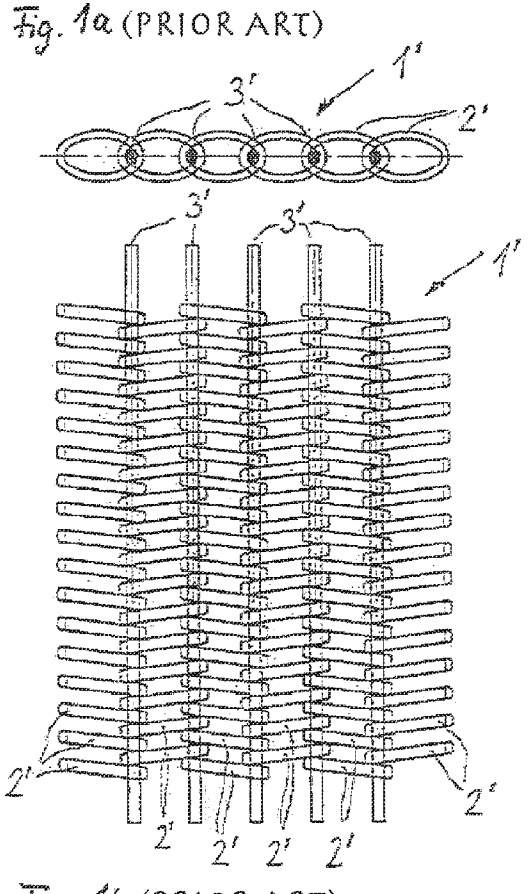
Fig. 1a (PRIOR ART)
Fig. 1b (PRIOR ART)

NON-THERMOSET SHEET-LIKE STRUCTURE FOR A SPIRAL SIEVE, AND METHOD FOR MANUFACTURING A SPIRAL SIEVE

This application is a 371 of PCT/EP2012/061559 filed 18 Jun. 2012

FIELD OF THE INVENTION

The invention relates to a non-thermoset sheet-like structure for a spiral sieve having a plurality of spirals which are located next to one another and mutually engage with adjacent spirals, and having a plurality of pintle wires which are inserted into mutually overlapping spiral portions of the adjacent spirals for connecting the spirals to one another, a void cross section being provided in the region of each spiral in the assembled state of the spirals, and a method for manufacturing a spiral sieve having a plurality of spirals which are joined together in an overlapping manner, having a plurality of pintle wires which are inserted into overlapping regions of adjacent spirals and which in this way connect the spirals to one another to form a sheet-like structure, and having a plurality of filler bodies which are introduced into void cross sections of the spirals of the sheet-like structure, the sheet-like structure undergoing a thermosetting process before or after the filler bodies have been introduced.

BACKGROUND OF THE INVENTION

Non-thermoset sheet-like structures which are used for the manufacturing of spiral sieves, in particular for use in paper-making machinery, are generally known. Such sheet-like structures are constructed from a plurality of spirals lying next to one another, which spirals are in each case manufactured in a continuous manner from a plastic monofilament. The helical spirals are dimensioned so as to be identical to one another and overlap one another with lateral spiral whorl portions which are inserted into adjacent spiral whorl portions of the laterally following spirals. The adjacent spirals are preferably implemented alternatingly in a right-handed and left-handed manner. In order to be able to connect the adjacent spirals to one another, pintle wires which are preferably likewise made from a plastic monofilament are provided. The pintle wires are inserted into overlapping spiral portions of in each case two adjacent spirals in the longitudinal direction of the spirals, on account of which the adjacent spirals are connected to one another. After joining together the sheet-like structure from a corresponding number of spirals and pintle wires, the sheet-like structure is subjected to a thermosetting process in which the sheet-like structure is stretched to a tension which is pre-specified by a calender and in which, on the basis of the temperature influence, said sheet-like structure also inherently generates tension on account of shrinking processes in the material, whereby the thickness of the sheet-like structure is reduced. In order to reduce air permeability of the sheet-like structure and of the spiral sieve, filler bodies which largely occupy the void cross section of each spiral are introduced from an end side into the void cross sections of the spirals. After manufacturing of the sheet-like structure by the composition of spirals and pintle wires, thermosetting of the sheet-like structure takes place. Depending on the embodiment, the filler bodies may be introduced before or after thermosetting.

SUMMARY OF THE INVENTION

It is an object of the invention to provide a non-thermoset sheet-like structure for a spiral sieve and a method for manufacturing a spiral sieve, on account of which a lower weight per unit area for the spiral sieve and an improved contact area with respect to the conveyed material are achieved.

This object is achieved for the non-thermoset sheet-like structure in that a clear width, extending in the plane of the sheet-like structure, of each void cross section is greater than a clear height, extending between spiral whorls lying on the top and on the bottom of each spiral, of each void cross section. On account of the solution according to the invention, lower air permeability of spiral sieves provided with filler bodies is achieved. This is because fewer pintle wires per unit area and fewer connection regions are necessary as a result of the spirals having a significantly greater width in relation to their height than known spirals, and so there are inevitably also fewer air passage openings. The reduced number of pintle wires for creating the composition of spirals and thus the sheet-like structure additionally ensures a lower weight per unit area than in conventional sheet-like structures for spiral sieves. The greater width of the spirals of the sheet-like structure also ensures an improved contact area with respect to the conveyed product, in particular paper webs. On account of this it is ensured that the spiral sieves for the paper-making industry which serve as drying sieves for the paper webs cause fewer marks in the paper, whereby the paper quality is enhanced. In addition, on account of the enlarged contact area, heat transfer from the spiral sieve to the drying medium is increased. On account of this, an increase in the drying speed and thus also an increase in the production speed are enabled. In the case of unchanging speed, a saving in energy would result in comparison with known spiral sieves in the field of the paper-making industry. This is because the time needed for the drying process could be reduced.

In an embodiment of the invention the ratio of clear width to clear height of each void cross section of the spirals of the sheet-like structure lies in a range between 1.01 and 2.50. Particularly advantageous are width-to-height ratios between 1.30 and 1.80.

In a further embodiment of the invention the spirals are manufactured from round wires or flat wires. Both round wires and flat wires are plastic wires. The use of flat wires further increases the contact area for the good to be conveyed.

In a further embodiment of the invention the round wires or flat wires are configured as monofilaments. On account of this, a rapid and simple manufacturing of the round wires or flat wires is possible, in particular in an extrusion process.

In a further embodiment of the invention the spirals have an external width in the range between 6.50 and 8.60 mm and an overall height in the range between 2.50 and 3.50 mm. Preferably the round wires have a diameter from within a range of 0.40 mm to 0.70 mm. The flat wires and/or the pintle wires are preferably provided with cross-sectional dimensions between 0.40 and 0.80 mm. These dimensionings are particularly advantageous for improving the solution according to the invention.

For the method of the type mentioned at the outset for manufacturing a spiral sieve, the object underlying the invention is achieved in that the spirals are joined together to form the sheet-like structure in such a manner that, prior to the thermosetting process, for the void cross sections of the spirals which are connected to one another to form the sheet-like structure there is, when viewed in a plane of the sheet-like structure, a clear width which is greater than a clear height of the void cross section of each spiral. On account of this method, the same advantages are achieved as have already been described for the non-thermoset sheet-like structure according to the invention and the spiral sieve manufactured therefrom. It is particularly advantageous for the method and also for the non-thermoset sheet-like structure that, already prior to the thermosetting process, the void cross sections of the sheet-like structure in the region of the spirals have a greater width than height. On account of this, filler bodies can already be pushed into the non-thermoset sheet-like structure and, on account of the configuration of the void cross sections, even in the non-thermoset state are held so securely between the spiral whorls of the sheet-like structure that in a subsequent thermosetting process no undesirable torsion or twist of the filler bodies, which are also described as filler wires, can arise. On account of this, a high quality is achieved in the completed spiral sieve.

BRIEF DESCRIPTION OF THE DRAWINGS

Further advantages and features of the invention result from the claims and also from the following description of a preferred exemplary embodiment of the invention, which is described by means of the drawings, in which:

FIGS. 1*a* and 1*b* show a known sheet-like structure for a known spiral sieve, FIGS. 2*a* and 2*b* show, on the same scale as FIGS. 1*a* and 1*b*, an embodiment of a sheet-like structure according to the invention for a spiral sieve, the comparison of FIGS. 1*a* and 1*b* and also 2*a* and 2*b* illustrating the different dimensionings.

DETAILED DESCRIPTION

An as yet non-thermoset sheet-like structure 1 according to FIGS. 2*a* to 4 is provided for a spiral fabric which is used in the paper-making industry. The non-thermoset sheet-like structure 1, which is described in more detail in the following, is yet to undergo a thermosetting process, is to be cut to size for the desired area dimensioning, and is to be straightened and fixed on its peripheral edges, in particular by a welding process. The sheet-like structure 1 consists of a multiplicity of spirals 2 which are dimensioned so as to be identical to one another. Each spiral 2 is continuously wound from a plastic monofilament, which may be implemented as a round wire or as a flat wire. As can be seen from the cross-sectional representations according to FIGS. 2*a* and 3, each spiral has an oval-like cross section. In order to create the sheet-like structure, the individual spirals 2 are brought together next to one another in an alternating manner with in each case reversed winding directions and with the lateral peripheral regions of their whorls in each case pushed in between corresponding lateral peripheral regions of the whorls of the adjacent spiral 2. As can be seen from FIGS. 2*b* and 4, on account of this two spiral portions, which in each case mutually overlap in an alternating manner with respect to their whorls, result for the adjacent spirals. It can be seen from FIGS. 2*a* and 3 that, when viewed in the longitudinal direction of the spirals 2, in each case channel portions are formed by this overlapping of the spiral portions of the adjacent spirals 2, through which channel portions the pintle wires 3 are pushed through or pulled through in the longitudinal direction in order to connect the adjacent spirals 2 to one another in this manner. The pintle wires 3 are likewise made from plastic and in the illustrated exemplary embodiment configured as a monofilament. The pintle wires 3 are implemented in a rectilineal manner. The composition of spirals 2 and pintle wires 3 configured in this way defines the sheet-like structure 1, which is required for the manufacturing of the spiral sieve.

Figure 3:
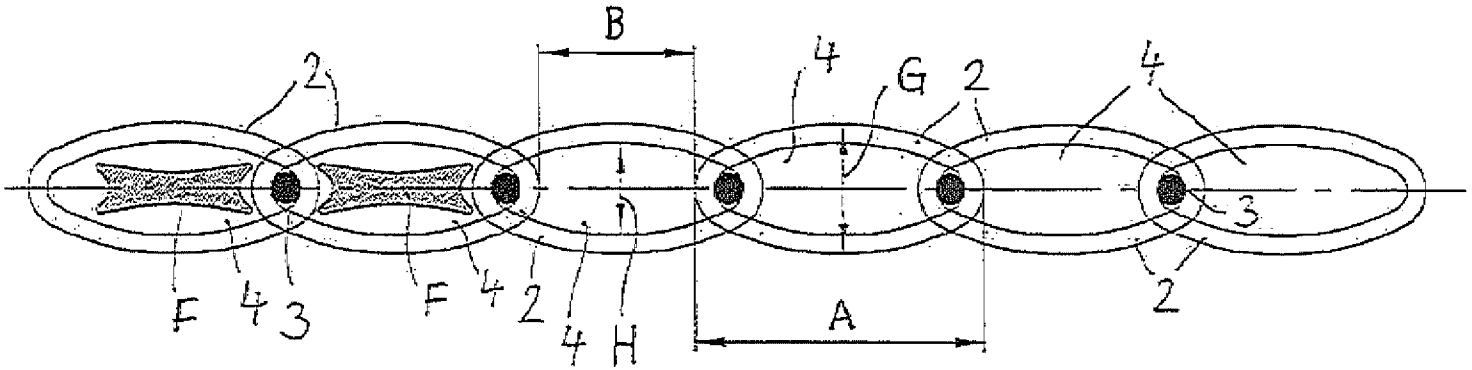
FIG. 3 shows in an enlarged representation in a schematic manner a cross section through the sheet-like structure according to FIG. 2*b* corresponding to 2*a*, but with two filler bodies.

As can be seen from FIGS. 2*a* and 3, continuous void cross sections 4 are created after manufacturing of the composition of spirals 2 and pintle wires 3 in the region of each spiral 4 in the longitudinal direction of the sheet-like structure 1, i.e. in the longitudinal direction of the pintle wires 3. The void cross sections 4 are delimited toward their sides, i.e. when viewed in the plane of the sheet-like structure 1, by corresponding outer peripheral regions of the spiral portions of the spirals 2 adjacent on the left and right. Towards the top and towards the bottom, the void cross sections 4 are in each case delimited by upper and lower whorl portions of the respective spiral 2, which whorl portions simultaneously also define an upper and a lower contact area of the sheet-like structure 1 and thus of the later spiral sieve.

A sheet-like structure 1' according to FIGS. 1*a* and 1*b*, which is known from the prior art, has a construction which is the same in principle. There too, spirals 2' are joined together via pintle wires 3' to form a composition. A significant difference in the case of the sheet-like structure 1' known from the prior art is that, in contrast to the sheet-like structure 1 according to the invention, the spirals 2' have a significantly smaller width in relation to their height than in the sheet-like structure 1 according to the invention as per FIGS. 2*a* to 4. The spirals 2 according to FIGS. 2*a* to 4, having a larger width than the spirals 2', are combined with the pintle wires 3, which are dimensioned so as to be identical to the pintle wires 3' in the prior art. On account of this, a void cross section 4, the width B (FIG. 3) of which is greater than its height H, results in the region of each spiral for the sheet-like structure 1 according to the invention. In corresponding void cross sections which result in the sheet-like structure 1' according to the prior art, the corresponding dimensionings are reversed. This means that in the prior art the width of the void cross sections is smaller than the height of the void cross sections in the region of the spirals 2' of the known sheet-like structure 1'.

It has to be emphasized that these explanations apply to the as yet non-thermoset sheet-like structure, i.e. prior to passing through a thermosetting process, both in the case of the known sheet-like structure 1' and in the case of the sheet-like structure 1 according to the invention as per FIGS. 2*a* to 4. This is because, in a thermosetting process, besides being stretched, the sheet-like structures are thermally stressed and, on account of this, shrink to a smaller thickness, simultaneously attaining a greater extent in the width.

As can be seen from FIG. 3, the width B of each void cross section 4 corresponds to the clear distance between opposite lateral peripheral regions of the spiral portions of the adjacent spirals 2. The clear height H of the void cross section 4 is defined by the greatest distance between the upper and lower whorl portions of the respective spiral 2. In the exemplary embodiment illustrated, this greatest distance is provided in the center of the respective void cross section 4. By means of FIG. 3, an external width A and an overall height G of each spiral 2 is defined. Particularly preferred dimensions of the spirals 2 of a sheet-like structure 1 according to the invention as per FIGS. 2*a* to 4 have an overall height G in the range between 2.50 mm and 3.50 mm and a preferred external width A in the range of 6.50 mm to 8.60 mm. Particularly advantageous are spirals 2 having a ratio of external width A to overall height G of 6.75 mm×2.90 mm, of 7.00 mm×3.00 mm and of 8.40 mm×3.40 mm. The plastic monofilament for the manufacturing of the spirals 2 is preferably composed of polyethylene terephthalate (PET) and is preferably implemented either as a flat wire with cross-sectional dimensions of 0.43 mm×0.70 mm or as a round wire with a diameter of 0.60 mm or 0.70 mm. The pintle wires 3 are likewise manufactured from PET and implemented as plastic monofilaments. They are preferably configured as round wires having a preferred diameter of 0.70 mm. The tolerances in the external width A and the overall height G of the spirals 2 may preferably vary within a tolerance range of ±0.20 mm.

In the case of an external width A of around 6.70 mm and an overall height of the spiral 2 of around 2.90 mm, a clear width B of around 3.50 mm and a clear height H of around 2.12 mm results in the composition for the sheet-like structure 1 for each void cross section 4. A width-to-height ratio B:H for each void cross section of 1.65:1 thus results in the case of such an embodiment.

Figure 4:
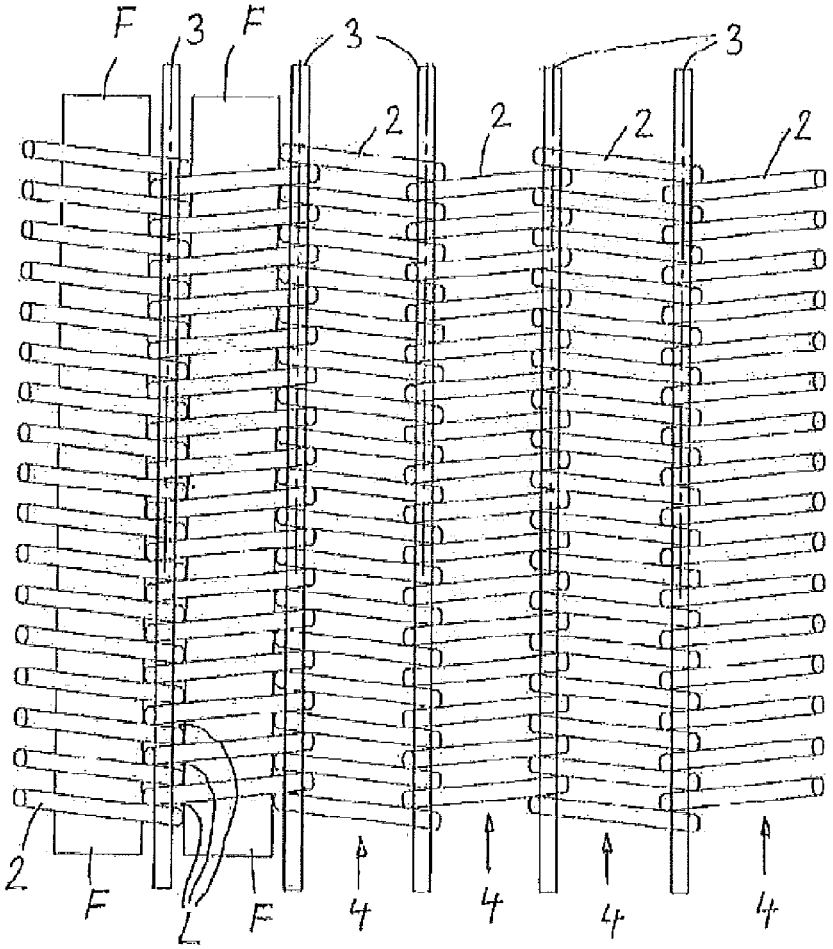
FIG. 4 shows on another scale a plan view of the sheet-like structure according to FIG. 3.

Cross-sectionally bone-shaped filler bodies F, which are largely adapted to the cross-sectional dimensions of the respective void cross section 4, as can be seen from FIGS. 3 and 4, can be introduced in the longitudinal direction into the void cross sections 4 configured in this manner. The filler bodies F may likewise be implemented from plastic as rectilineal filler wires having a cross section according to FIG. 3. When viewed in the plan view of the sheet-like structure 1, only small air passage openings L still remain after the introduction of the filler bodies F, which air passage openings L can be seen from FIG. 4 and lie between the lateral peripheral edges of the filler bodies F and the pintle wires 3 and also the correspondingly overlapping spiral portions of the adjacent spirals 2.

The filler bodies F in the illustrated exemplary embodiment are likewise inserted into the void cross sections 4 of the composition of spirals 2 and pintle wires 3 prior to thermosetting of the sheet-like structure 1. Thereafter, a thermosetting process which is known in principle for the manufacturing of spiral sieves takes place, in which thermosetting process, besides thermal stress, the sheet-like structure 1 is exposed to a certain tensioning in the longitudinal direction. Moreover, the sheet-like structure 1 itself generates tension as a result of the inherent shrinkage of the plastic spirals 2, such that the sheet-like structure 1 is stretched, the thickness being reduced on account of this, and is thermoset in this flatter state.

The invention claimed is:

1. A non-thermoset sheet-like structure for a spiral sieve having a plurality of spirals which are located next to one another and mutually engaged with adjacent spirals, and having a plurality of pintle wires which are inserted into mutually overlapping spiral portions of the adjacent spirals for connecting the spirals to one another, a void cross section being provided in a region of each spiral in an assembled state of the spirals, wherein a clear width, extending in a plane of the sheet-like structure, of each void cross section is greater than a clear height, extending between spiral whorls lying on a top and on a bottom of each spiral, of each void cross section.

2. The non-thermoset sheet-like structure as claimed in claim 1, wherein a ratio of clear width to clear height of each void cross section of the spirals of the sheet-like structure lies in a range between 1.01 and 2.0.

3. The non-thermoset sheet-like structure as claimed in claim 2, wherein the spirals are manufactured from round wires or flat wires.

4. The non-thermoset sheet-like structure as claimed in claim 3, wherein the round wires or flat wires are configured as monofilaments.

5. The non-thermoset sheet-like structure as claimed in claim 1, wherein the spirals are manufactured from round wires or flat wires.

6. The non-thermoset sheet-like structure as claimed in claim 5, wherein the round wires or flat wires are configured as monofilaments.

7. The non-thermoset sheet-like structure as claimed in claim 6, wherein the round wires have a diameter from within a range of 0.40 mm to 0.70 mm.

8. The non-thermoset sheet-like structure as claimed in claim 5, wherein the round wires have a diameter from within a range of 0.40 mm to 0.70 mm.

9. The non-thermoset sheet-like structure as claimed in claim 5, wherein the flat wires and/or the pintle wires have cross-sectional dimensions between 0.40 and 0.80 mm.

10. The non-thermoset sheet-like structure as claimed in claim 1, wherein the spirals have an external width in a range between 6.50 and 8.60 mm and an overall height in a range between 2.50 and 3.50 mm.

11. The non-thermoset sheet-like structure as claimed in claim 1, wherein a ratio of clear width to clear height of each void cross section of the spirals of the sheet-like structure lies in a range between 1.30 and 1.80.

12. A method for manufacturing a spiral sieve from the sheet-like structure of claim 1 comprising introducing a plurality of filler bodies into the void cross sections of the spirals, the sheet-like structure undergoing a thermosetting process before or after the filler bodies have been introduced, wherein the spirals are joined together to form the sheet-like structure in such a manner that, prior to the thermosetting process, the clear width is greater than the clear height of the void cross section of each spiral.

13. A spiral sieve which is manufactured according to the method as claimed in claim 12.

14. A non-thermoset sheet-like structure for a spiral sieve comprising:

a plurality of spirals which are located next to one another and mutually engaged with adjacent spirals, each spiral including a pair of opposite arc portions and a pair of opposite connecting portions connecting the pair of opposite arc portions;

the plurality of spirals including a first spiral, a second spiral and a third spiral;

a first one of the arc portions of the first spiral overlapping a first one of the arc portions of the second spiral to form a first overlapping spiral portion;

a second one of the arc portions of the second spiral overlapping a first one of the arc portions of the third spiral to form a second overlapping spiral portion;

a plurality of pintle wires inserted into the first and second overlapping spiral portions for connecting the first, second and third spirals to one another;

a width of a void cross section of the second spiral being located between the first one of the arc portions of the first spiral and the first one of the arc portions of the third spiral;

a height of the void cross section of the second spiral being located between the pair of opposite connecting portions of the second spiral; and the width is greater than the height.

15. The non-thermoset sheet-like structure as claimed in claim 14, wherein a ratio of the width to the height of the void cross section lies in a range between 1.01 and 2.0.

16. The non-thermoset sheet-like structure as claimed in claim 14, wherein the spirals have an external width in a range between 6.50 and 8.60 mm and an overall height in a range between 2.50 and 3.50 mm.

17. The non-thermoset sheet-like structure as claimed in claim 14, wherein a ratio of the width to the height of each void cross section of the spirals of the sheet-like structure lies in a range between 1.30 and 1.80.

* * * * *